US010406419B1

(12) United States Patent
Dickerson

(10) Patent No.: US 10,406,419 B1
(45) Date of Patent: Sep. 10, 2019

(54) BATTING PRACTICE STAND

(71) Applicant: Rukket, LLC, Wilmington, DE (US)

(72) Inventor: Ryan L. Dickerson, Athens, GA (US)

(73) Assignee: Rukket, LLC, Wilmington, DE (US)

( * ) Notice: Subject to any disclaimer, the term of this patent is extended or adjusted under 35 U.S.C. 154(b) by 0 days.

(21) Appl. No.: 16/239,900

(22) Filed: Jan. 4, 2019

Related U.S. Application Data

(60) Provisional application No. 62/615,981, filed on Jan. 11, 2018.

(51) Int. Cl.
*A63B 69/00* (2006.01)

(52) U.S. Cl.
CPC ..... *A63B 69/0091* (2013.01); *A63B 69/0002* (2013.01); *A63B 2069/0008* (2013.01); *A63B 2225/093* (2013.01)

(58) Field of Classification Search
CPC ..... A63B 2210/50; A63B 69/0002; A63B 2069/0008; A63B 69/0075
USPC ..... 473/417–420
See application file for complete search history.

(56) References Cited

U.S. PATENT DOCUMENTS 5,303,914 A * 4/1994 Cooksey ..... A63B 69/0091 473/429
D415,805 S * 10/1999 Wygonik ..... D16/244
7,281,998 B2 10/2007 Tanner
8,033,934 B1 * 10/2011 Clancy ..... A63B 43/007 473/422
8,246,492 B2 8/2012 Gangelhoff
8,672,780 B2 3/2014 Fournier
8,734,274 B1 * 5/2014 Hochberg ..... A63B 69/0002 473/417
8,821,322 B1 9/2014 Jorgens et al.
9,623,308 B2 * 4/2017 Bourgeois ..... A63B 69/0002
9,649,544 B2 5/2017 Fitzpatrick et al.
9,827,475 B2 11/2017 Holland et al.
D811,502 S * 2/2018 Nelson ..... D21/717
9,889,359 B2 2/2018 Ouellette
(Continued)

*Primary Examiner* — Mark S Graham
(74) *Attorney, Agent, or Firm* — Rogowski Law LLC

(57) ABSTRACT

A batting practice stand has a length-adjustable post that has a ball-receiving cone at one end and L-shaped slots through its sidewall at its opposite end. By axially sliding the post into an opening of the base and rotating, the L-shaped slots engage a bar within the base opening to secure the post to the base. A compressible washer or stopper is provided in the bottom portion of the base to facilitate connection between L-shaped slots of the post and bar within the base. Legs extend outwardly from between flanges of the sidewall of the base. Between the flanges, the base defines socket openings that receive curved detent buttons extending from the proximal ends of each of the legs. Pins extend across the flanges and through the legs, and are engaged by slots defined in the curved detent buttons. The legs are rotatably moved from a storage position aligned with the legs substantially parallel to one another to a stand support position with the legs at angles to one another. The pins define the axis of rotation for the legs. Springs urge the curved detent buttons in a direction outwardly of the legs to keep the curved detent buttons within the socket openings in the base. Double gaskets at the connections between the telescoping post segments permit easy extension of the telescoping post segments, while resisting closing.

20 Claims, 9 Drawing Sheets

FIG. 22

(56) References Cited

U.S. PATENT DOCUMENTS

| | | | | |
|---|---|---|---|---|
| 9,914,034 | B2 * | 3/2018 | Lee | A63B 69/0002 |
| 2006/0205540 | A1 * | 9/2006 | Liu | A63B 69/0002<br>473/417 |
| 2007/0259728 | A1 * | 11/2007 | Whitefield | A63B 63/06<br>473/185 |
| 2009/0082140 | A1 * | 3/2009 | Liao | A63B 69/0002<br>473/417 |
| 2010/0016100 | A1 * | 1/2010 | Liu | A63B 69/0002<br>473/417 |
| 2013/0178313 | A1 * | 7/2013 | Meier | A63B 69/0002<br>473/417 |
| 2014/0302948 | A1 * | 10/2014 | Holland | A63B 69/0075<br>473/417 |
| 2014/0364255 | A1 * | 12/2014 | Nelson | A63B 69/0075<br>473/417 |
| 2015/0231470 | A1 * | 8/2015 | Kanner | A63B 69/0002<br>473/417 |
| 2016/0096097 | A1 * | 4/2016 | Erlandson | A63B 69/0075<br>473/417 |

* cited by examiner

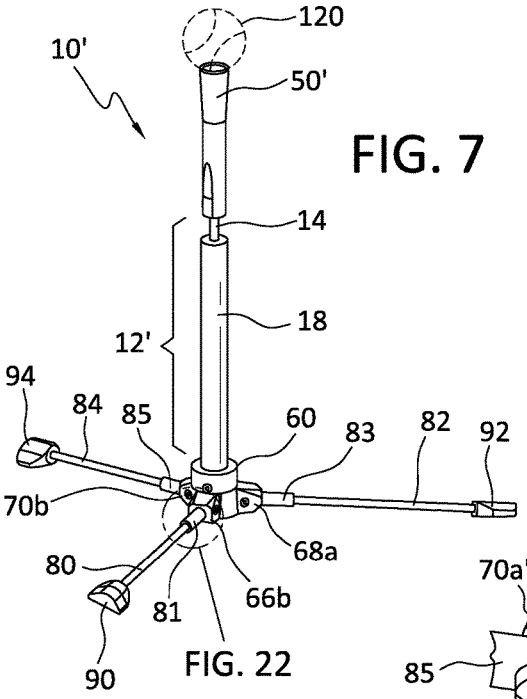
FIG. 7
FIG. 22
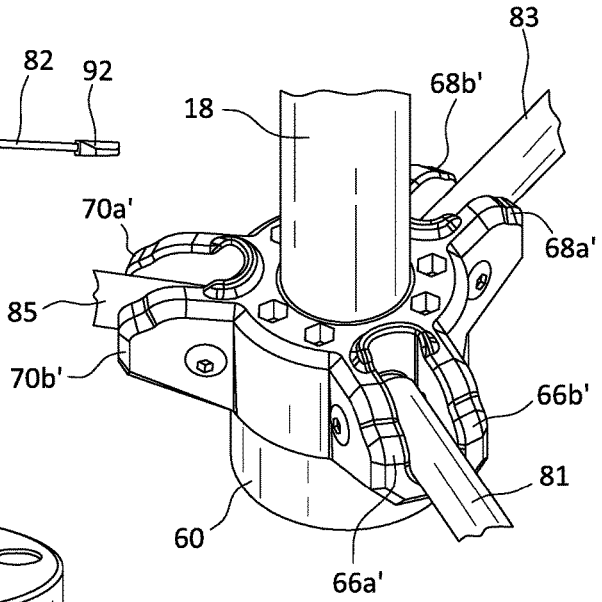
FIG. 8
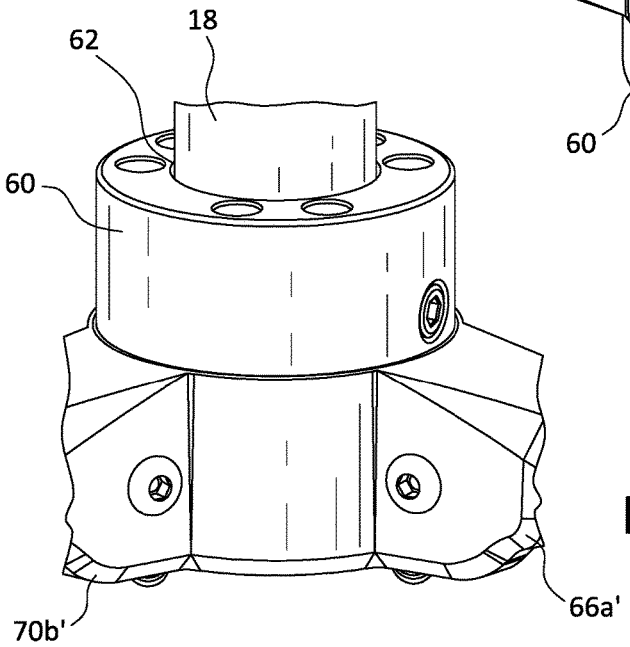
FIG. 9

BATTING PRACTICE STAND

CROSS-REFERENCE TO RELATED APPLICATION

This application claims priority under 35 USC § 119(e) to U.S. Provisional Application Ser. No. 62/615,981, entitled "Batting Practice Stand", filed Jan. 11, 2018, the disclosure of which is incorporated by reference herein.

FIELD OF THE INVENTION

The present invention is generally directed to an adjustable height stand to hold baseballs or softballs at different heights for batting practice.

BACKGROUND OF THE INVENTION

Baseball and softball players frequently practice batting and refining their swing using a stationary stand or tee onto the top of which a ball is placed for hitting with a bat. The stands or tees must be sturdy enough to hold the ball in place for the batter to hit, and remain in place without tipping, or recover to vertical after the ball is hit. Such stands or tees often must be transported to new locations.

Compromises are made in construction to accommodate conflicting objectives. Some batting stands include heavy cast iron bases, sometimes shaped in the configuration of a home plate diamond. The heavy bases counteract forces on the stand to help prevent tipping, but also add substantial weight making the stands more difficult to transport. Some batting stands are made of molded plastic that is filled with ballast, again making transport less convenient. Moreover, a large-sized batting stand is more difficult to handle and transport.

Other batting stands are designed specifically for smaller children, and have molded plastic stands shaped as home plate configurations. These stands are generally lighter weight, but less stable, and therefore more subject to tipping. Still other batting stands provide tripod or other footer configurations that splay outwardly away from the stand post, making transport awkward. In some designs the tripod legs and feet are separated from the base for transport, and invariably are misplaced or broken from repeated use and transport.

Improvements to batting practice stands and t-ball batting stands continue to be sought.

BRIEF SUMMARY OF THE INVENTION

In a first embodiment of the invention, a batting practice stand has a post with a top or distal end and a bottom or proximal end. The post is length-adjustable to vary the height of the batting practice stand. Preferably, the post is telescoping, and formed of two or more sections that nest within one another in an axial direction. A cone is formed at or joined to the distal end of the post. The cone receives and holds a ball to be hit by a user.

The post is removably attachable to a base. The proximal end of the post defines at least two L-shaped slots through the post sidewall. The L-shaped slots engage with a bar in an opening in the top of the base. By axially inserting the proximal end of the post into the opening, and then rotating the proximal end, the L-shaped slots secure the post to the base. The post may be removed by rotating the proximal end in the opposite rotational direction and pulling the post out. Preferably, a washer or stopper is inserted into the proximal end of the post, so that the user will not over-insert the post into the base. The washer or stopper creates force on the bar that keeps the post locked into position.

The base has at least two pairs of flanges, and preferably three pairs of flanges, extending outwardly away from the side of the base. Individual curved sockets are defined in the base between each pair of flanges. Legs that terminate at feet are joined to the base between the flanges. Each leg has a curved detent button extending from its proximal end. The curved detent button is urged outwardly of the proximal end of the leg by a spring located inside the leg. The curved detent buttons preferably are semispherical and seat inside respective curved sockets of the base. Preferably, there are two sockets located between each pair of flanges. Pins extend across the respective openings between each pair of flanges, through the sidewall of the proximal end of the leg, and through a slot formed in the curved detent button. Each pin defines an axis of rotation for a respective leg. The curved detent button slidably moves in respect to its associated pin. The legs are moved from a storage position aligned with leg axes substantially parallel to one another to a support position with leg axes at angles to one another by slidably rotating the curved detent buttons within their respective first sockets into their respective second sockets. The first and second sockets associated with each pair of flanges are oriented with their opening disposed at angles to one another.

The post preferably is length-adjustable with two or more telescoping segments joined together. In a particularly preferred embodiment, the topmost segment of the post is a solid material, such as fiberglass, with a threaded female part inserted into its proximal end configured to receive a gasket mounting. A retaining pin is laterally inserted through the sidewall of the topmost segment of the post and through the fitting holding a gasket material to the topmost segment of the post.

A gasket is secured to the topmost segment of the post. In a particularly preferred embodiment, the gasket may be a double gasket having a first gasket with a cut out portion around its center and a second gasket with an angled outer face seated in the cut out portion of the first gasket. The angled outer face preferably is directed at an angle from about 3 degrees to about 10 degrees from a central axis of the post.

BRIEF DESCRIPTION OF THE DRAWINGS

The foregoing summary, as well as the following detailed description of the disclosure, will be better understood when read in conjunction with the appended drawings. For the purpose of illustrating the disclosure, there is shown in the drawings an embodiment of a batting practice stand which is presently preferred. It should be understood, however, that the disclosure is not limited to the precise arrangements and instrumentalities shown. In the drawings:

FIG. 7 is a right front perspective view of a batting practice stand according to a second embodiment of the invention;

FIG. 8 is an enlarged perspective view of the base of the batting practice stand of FIG. 7;

FIG. 9 is another enlarged perspective view of the base of the batting practice stand of FIG. 7;

DESCRIPTION OF THE DISCLOSURE

Certain terminology is used in the following description for convenience only and is not limiting. Unless specifically set forth herein, the terms "a," "an" and "the" are not limited to one element, but instead should be read as meaning "at least one." The terminology includes the words noted above, derivatives thereof and words of similar import.

It also should be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 1:
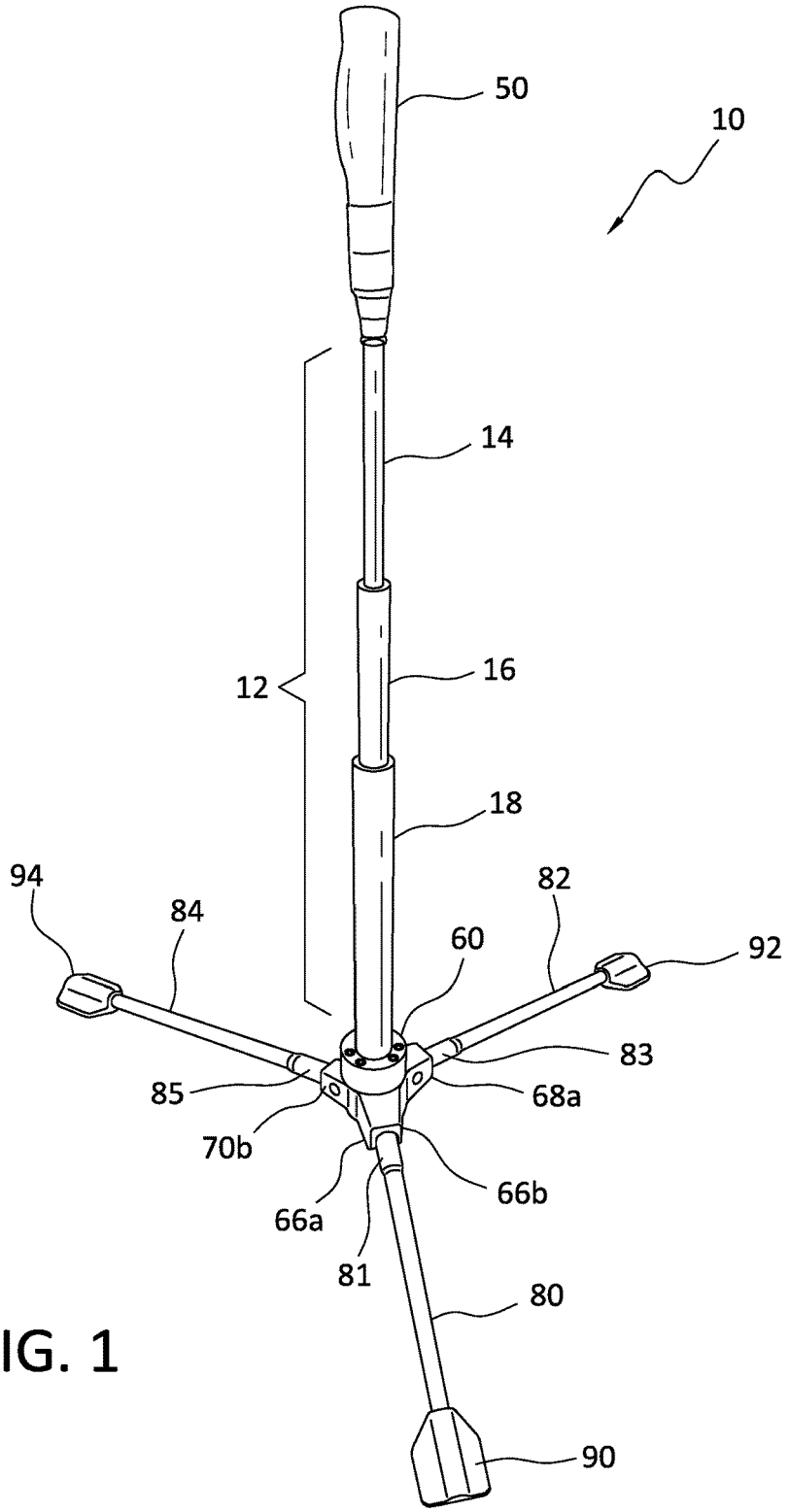
FIG. 1 is a right front perspective view of a batting practice stand according to a first embodiment of the invention.

Referring to the drawings in detail, FIG. 1 shows a batting practice stand 10 with a post 12 removably joined to a base 60. The stand 10 has a telescoping post 12 with a top post segment 14 that is received within a mid post segment 16 that is received within a bottom post segment 18. A cone 50 is joined by its distal end to the top of the top portion 14 of the post of the assembled batting practice stand 10. The cone 50 preferably is a rolled polymer or rubber and defines an opening 52 at its top end to receive a baseball 120 or softball (see, e.g., FIG. 7) placed thereon that is to be struck by a bat swung by a player. The cone 50 is flexible and will bend and recover upon being struck by the bat.

Figure 2:
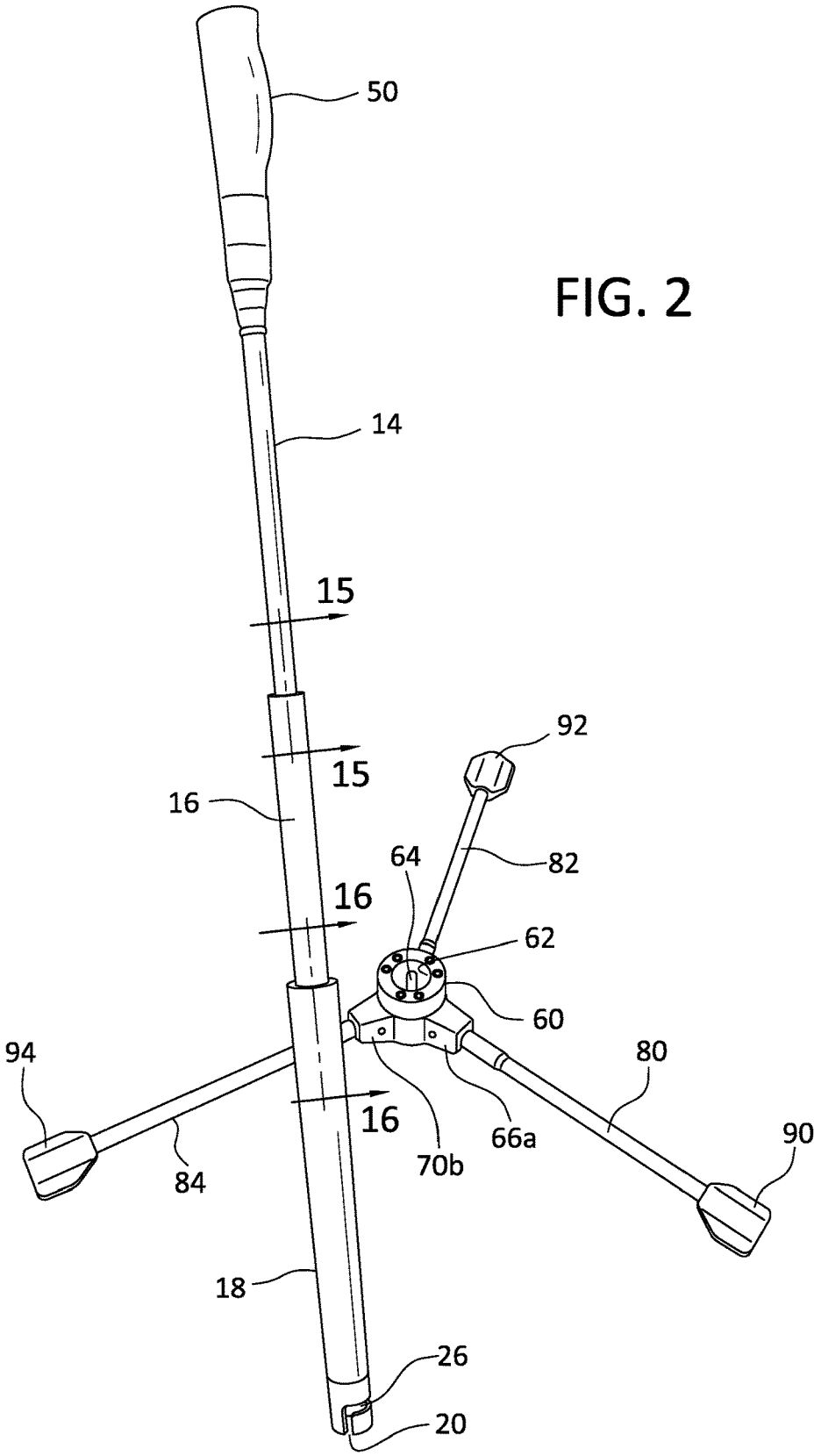
FIG. 2 is a right front perspective view of the batting practice stand of FIG. 1 with the post separated from the base.

As shown in FIGS. 1 and 2, the post is a three-part telescoping post, with the top or distal portion 14 slidably engagable within a middle portion 16 that is in turn slidably engagable within a bottom or proximal portion 18. The telescoping slidable movement of the post 12 enables post height to be adjusted within a range of about 20 inches to about 32 inches in one embodiment. Compare FIG. 1 and FIG. 7. The post 12 may be constructed of metal tubing of different diameters, such as steel or galvanized steel or aluminum, or may be constructed of a composite material, such as fiberglass. In one embodiment, the topmost post segment 14 is formed of solid fiberglass, and the middle post segment 16 and bottom post segment 18 are formed of hollow metal tubes of different diameters. Preferably, some or all of the post segments 14, 16, 18 are coated with a polymeric coating or paint.

Figure 13:
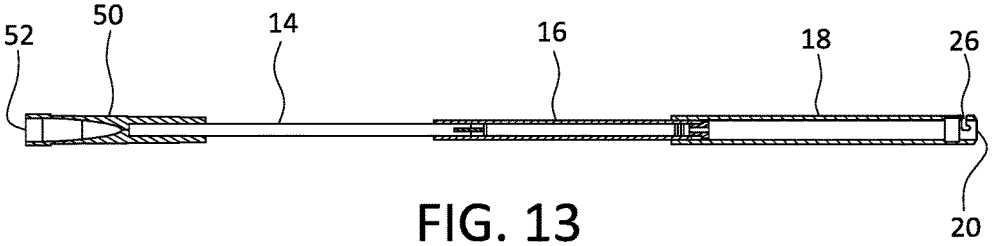
FIG. 13 is a cross-sectional view of the telescoping post of the batting practice stand of FIG. 7.
Figure 14:
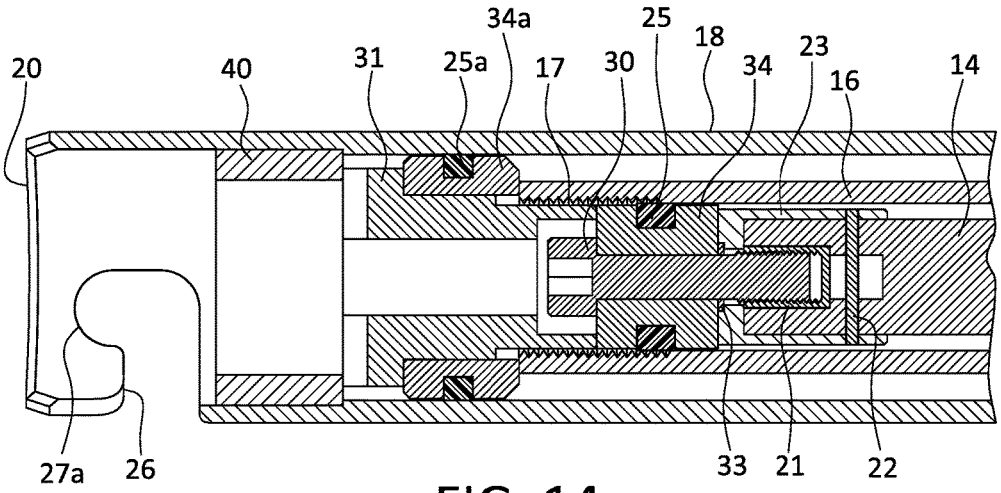
FIG. 14 is an enlarged cross-sectional view of the lower segment of the telescoping post of the batting practice stand of FIG. 7 with the upper and mid post segments inside the lower post segment and showing a rubber piece that enables enhanced engagement of the telescoping post to the base.
Figure 15:
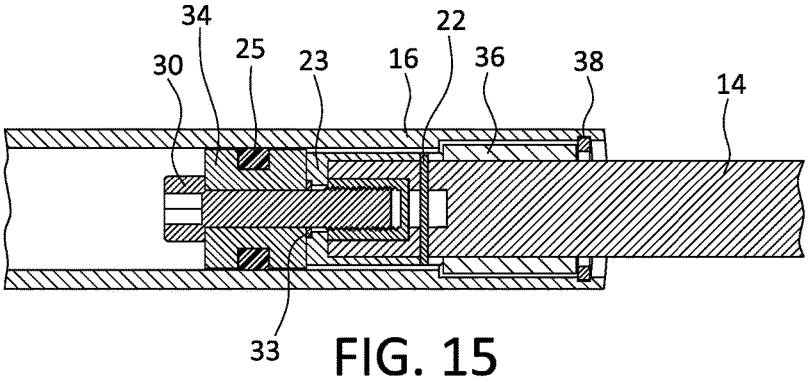
FIG. 15 is an enlarged cross-sectional view of the middle segment of the telescoping post connected to the top or distal portion for the batting practice stand taken along line 15-15 of FIG. 2.
Figure 16:
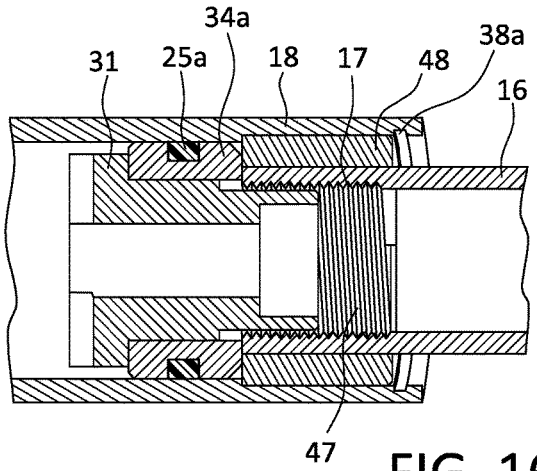
FIG. 16 is an enlarged cross-sectional view of the middle segment of the telescoping post connected to the lower segment of the telescoping post of the batting practice stand taken along line 16-16 of FIG. 2.
Figure 17:
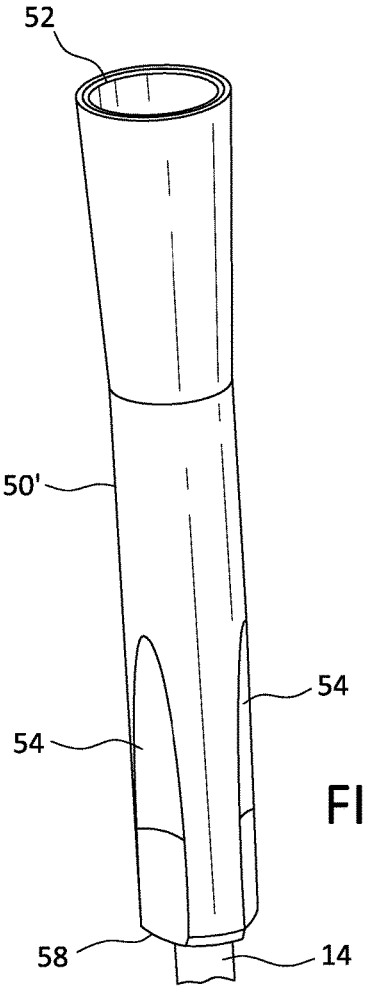
FIG. 17 is an enlarged perspective view of the cone at the distal end of the telescoping post of the batting practice stand of FIG. 7.

Cross-sections of the telescoping post 12 and sections of the telescoping post are shown in FIGS. 13-16. As shown in FIG. 15, the topmost post segment 14 is slidably joined to the middle post segment 16. As shown in FIGS. 14 and 16, the middle post segment 16 is slidably joined to the bottom post segment 18.

Figure 19:
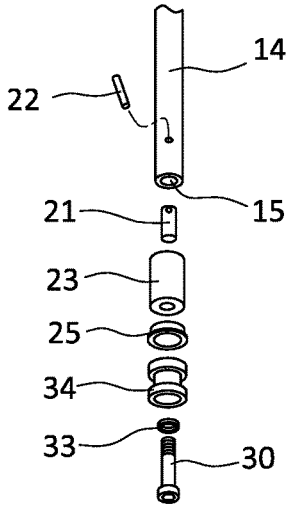
FIG. 19 is an exploded view of the upper post segment of the telescoping post of the batting practice stand of FIG. 7 at a location connecting the upper post segment to the middle post segment.

In FIGS. 13, 15 and 19 the topmost post segment 14 is a solid rod, such as a fiberglass rod, which has a hollowed proximal end portion 15 into which a fastener 30, such as a screw or carriage bolt, is engaged. A gasket 36 inside the middle post segment is held by a c-shaped clip 38 fitted in a groove of the middle post segment 16. The gasket 36 surrounds the bottom portion of the topmost post segment 14. A sleeve fitting 23 abuts the gasket 36. A thimble shaped flanged gasket 34 abuts the fitting 23. The gasket 36 slidably engages the outer wall of the topmost post segment 14. The thimble-shaped flanged gasket 34 that is joined to the topmost post segment 14 slides within the middle post segment 16. A flanged gasket 25 seats within the recess opening of the thimble-shaped flanged gasket 34.

In FIGS. 14 and 16 the middle post segment 16 is movably joined to the bottom post segment 18. The middle post segment 16 has a threaded proximal end 17 adapted to engaged with a threaded insert 21 and the threaded insert engages with a fastener 31. The fastener 31 secures a thimble-shaped gasket **34*a* with a flanged gasket 25*a* thereon to the proximal end of the middle post segment 16. A gasket 48 is held within the distal end of the bottom post segment 18 by a c-shaped clip 38*a* held within a groove in the bottom post segment 18. The double gasket comprised of gasket 34*a* and gasket 25*a* enables easier lengthening of the post 12 by slidably pulling the middle post segment 16 in a direction outwardly from the bottom post segment 18. The double gasket (e.g., 25***a*, 34*a*) poses greater resistance to shortening the length of the post 12 by frictional engagement of the double gasket (25*a*, 34*a*) to the inner wall of the bottom post segment 18.

Figure 4:
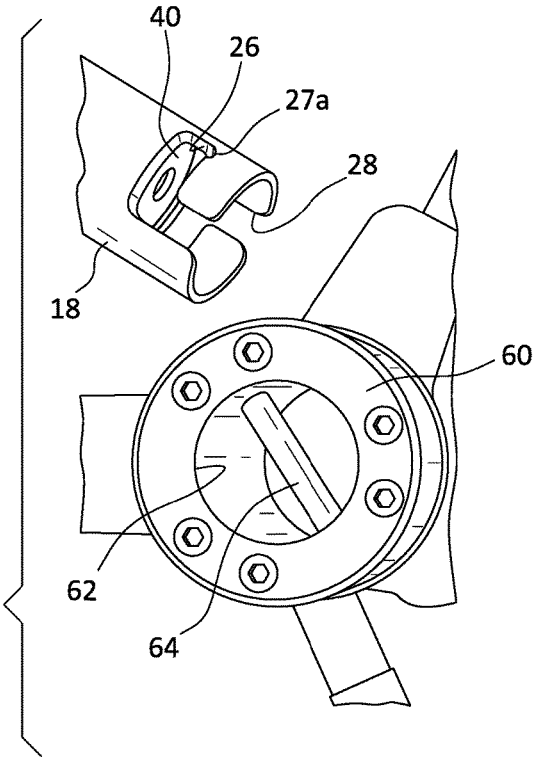
FIG. 4 is a magnified view of the proximal end of the post adjacent to the opening in the top of the base.
Figure 5:
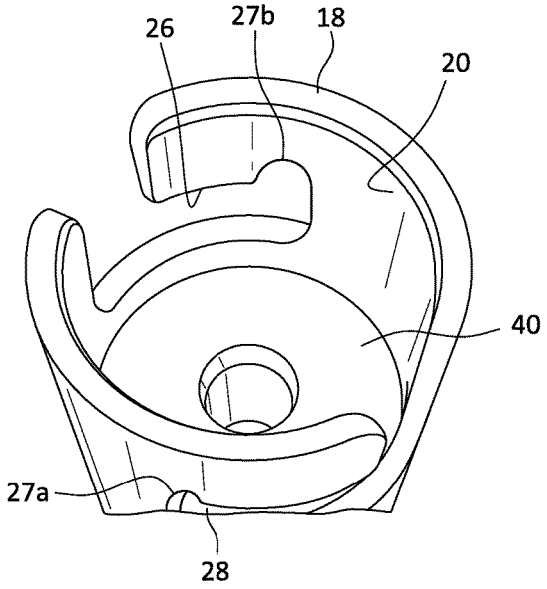
FIG. 5 is a magnified view of the proximal end of the post.

Referring to FIGS. 4 and 5, the proximal end 20 of the post is formed as a hollow cylinder that has two L-shaped slots 26, 28 formed at opposite sides of the sidewall of proximal end 20 of the post 12. The L-shaped slots 26, 28 have a straight that is aligned generally parallel with the central axis of the post and a straight that is generally perpendicular to the central axis of the post. A washer or stopper 40, such as a silicone washer, is placed inside the post 12 at or near its proximal end 20.

As shown in FIGS. 2 and 4, the base 60 defines an opening 62 to receive the proximal end 20 of the post 12. Within the opening 62, a bar 64 extends across. The two L-shaped slots 26, 28 of the post 12 are adapted to engage the bar 64 to secure the post 12 to the base 60. First, the proximal end 20 of the post 12 is inserted into the central opening 62 of the base 60 so that the straights of the L-shaped slots 26, 28 that are axially aligned with the post axis receive the bar 64. Then, the proximal end 20 of the post 12 is rotated in a first direction (either clockwise or counter-clockwise depending upon the orientation of the L-shaped slots) so that the straights of the L-shaped slots 26, 28 that are generally perpendicular to the axis of the post 12 receive the bar 64. In the embodiment shown in FIG. 4, the post 12 is rotated clockwise for the slots 26, 28 to engage the bar 64. The post 12 may be removed from the base 60 by pushing down and rotating the proximal end of the post in the opposite direction (either counter-clockwise or clockwise) to release the L-shaped slots 26, 28 from the bar 64 and then pulling the proximal end 20 of the post 12 out of the base opening 62. See FIG. 2.

The straights of the L-shaped slots terminate in cut outs 27*a*, 27*b* configured to receive the bar 64. The washer or stopper 40 inside the proximal end 20 of the post 12 facilitates a gripping connection between the post 12 and the bar 64 of the base 60. When the proximal portion 20 of the telescoping post or upright is inserted into the flange bushing of the base with the horizontal bar 64 in it and rotated, the washer or stopper 40 pushes down against the horizontal bar 64. When the bar 64 reaches the end of the channel, it is pushed down into the deeper recesses or cut outs 27*a*, 27*b* in the straights of the L-shaped slots and "clicks" into place, seating the bar 64 into the cut outs 27*a*, 27*b*.

The legs 80, 82, 84 with feet 90, 92, 94 of the embodiment shown in FIGS. 1-6 form a tripod and extend outwardly away from the base 60 to support the batting practice stand 10 in upright position. The legs 80, 82, 84 may also be retracted to a storage position when the batting practice stand is not in use. See FIG. 3. Surfaces near the proximal ends of the legs 80, 82, 84 may be covered by protective sleeves 81, 83, 85, such as polymeric or rubber sleeves.

Figure 3:
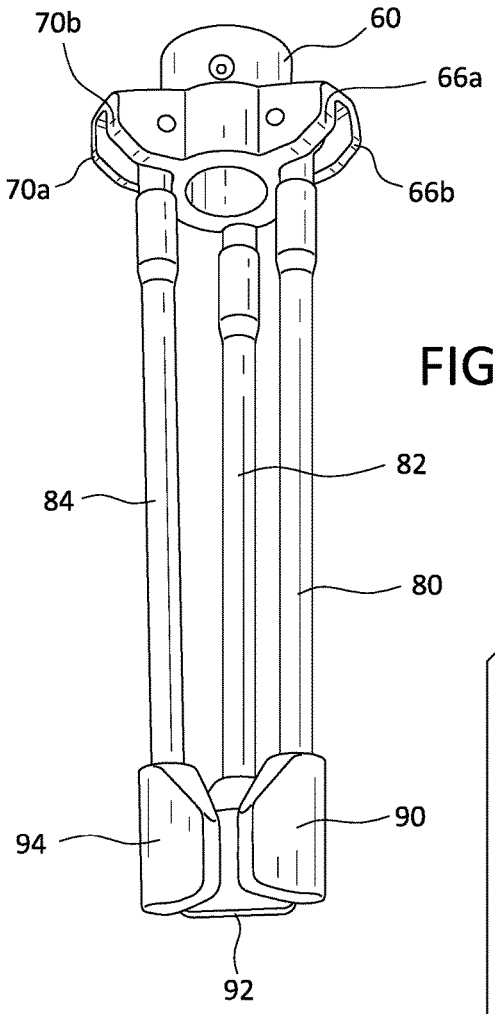
FIG. 3 is a right front perspective view of the base in retracted or storage position.
Figure 6:
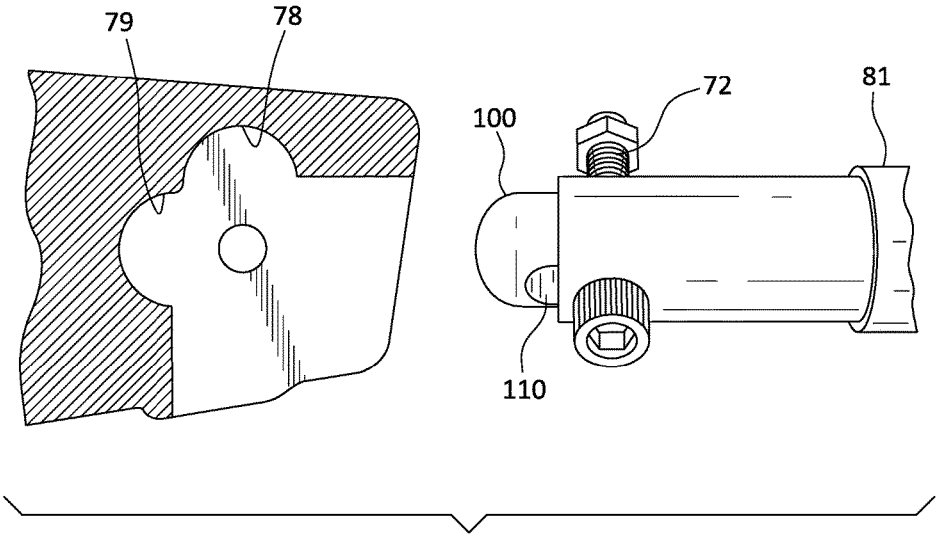
FIG. 6 is a partial cross section magnified view of the socket opening in the base, and the proximal end of the foot with a curved detent button.
Figure 22:
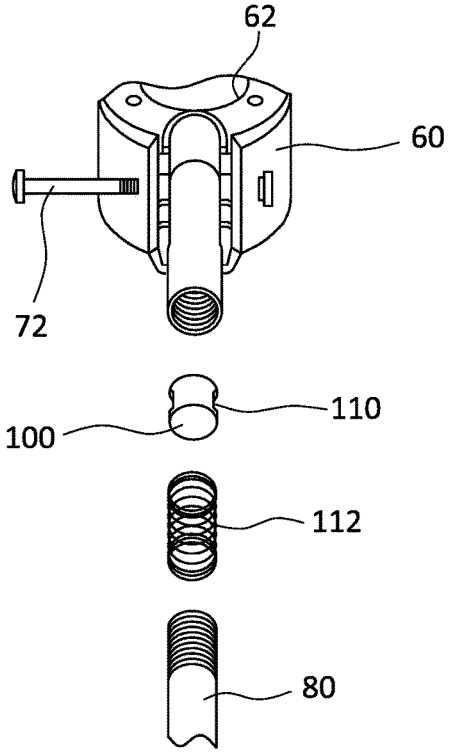
FIG. 22 is an exploded view of a leg connected to the base of the batting practice stand of FIG. 7.

Referring now in particular detail to FIGS. 3 and 6, pairs of flanges 66*a*, 66*b*, 68*a*, 68*b*, 70*a*, 70*b* extend outwardly from the sidewall of the base 60. Between the flanges, the base 60 defines curved sockets 78, 79. The curved sockets 78, 79 are shaped to receive curved detent buttons 100 (or bearings) that extend from the proximal ends of the legs 80, 82, 84. When the batting practice stand 10 is in the upright position, each socket 79 receives one curved detent button 100. The socket 79 is oriented in a direction at an angle to the opening of socket 78. A pin 72 extends across the space opening between each pair of flanges, e.g., 66*a*, 66*b*. Each pin 72 is inserted through the sidewalls of the proximal end of a respective leg, and through a slot 110 formed in the curved detent button 100 of a respective leg. The curved detent button 100 is slidably movable in respect of the pin 72. A compression spring (not shown in FIGS. 1-6, see 112 in FIG. 22) held within the proximal end of the leg, e.g., 80 (See FIG. 6) urges the curved detent button 100 in a directly outwardly of the proximal end of the leg. The pin 72 defines the axis of rotation for the leg joined to such pin 72.

The operation of the folding legs is described with reference to one leg 80 as shown in FIG. 6. Due to the semi-spherical curve of the outer surface of the curved detent button 100, such button 100 seats within a respective socket 79 of the base 60, and is moveable in relation thereto. The spring force of the compression spring associated with the curved detent button 100 may be overcome to push the curved detent button 100 further into the proximal end of the leg 80 to permit the leg 80 to rotate from a first position supporting the batting practice stand in upright position (such as shown in FIG. 1) with the leg axes at angles to one another, to a second or storage position wherein the legs 80, 82, 84 are joined to the base 60 with their axes generally parallel to one another (such as shown in FIG. 3). When the legs are moved to the storage position, each curved detent button 100 moves from the respective socket 79 to the other respective socket 78. The outer surface of the button 100 slides in contact with the socket surfaces during rotating movement of the leg 80 from the first to the second position.

The spring preferably is a conical spring or a conical coil spring.

The base 60, particularly the flanges 66*a*, 66*b*, 68*a*, 68*b*, 70*a*, 70*b*, preferably is formed of metal, such as steel, galvanized steel or aluminum. The top opening 62 of the base 60 may be formed as a separate tubular socket that is attachable to the base 60. The sockets 78 of the base 60 may be separate inserts fitted into space between the flanges 66*a*, 66*b*, 68*a*, 68*b*, 70*a*, 70*b*. The sockets 78 may be formed of silicone or plastic or polymer.

Referring next to the embodiment shown in FIGS. 7 to 18, FIG. 7 shows a batting practice stand 10' with a post 12' removably joined to a base 60. The stand 10' has a telescoping post 12' with a cone 50' joined at its distal end 58 at the top of the assembled batting practice stand 10'. See FIGS. 13, 17 and 18. The cone 50' preferably is a molded polymer or rubber and defines an opening 52 at its top end to receive a baseball 120 or softball. The cone 50' further defines hand grip recesses 54 in its outer surface. The cone 50' is flexible and will bend and recover upon being struck by a bat.

Figure 18:
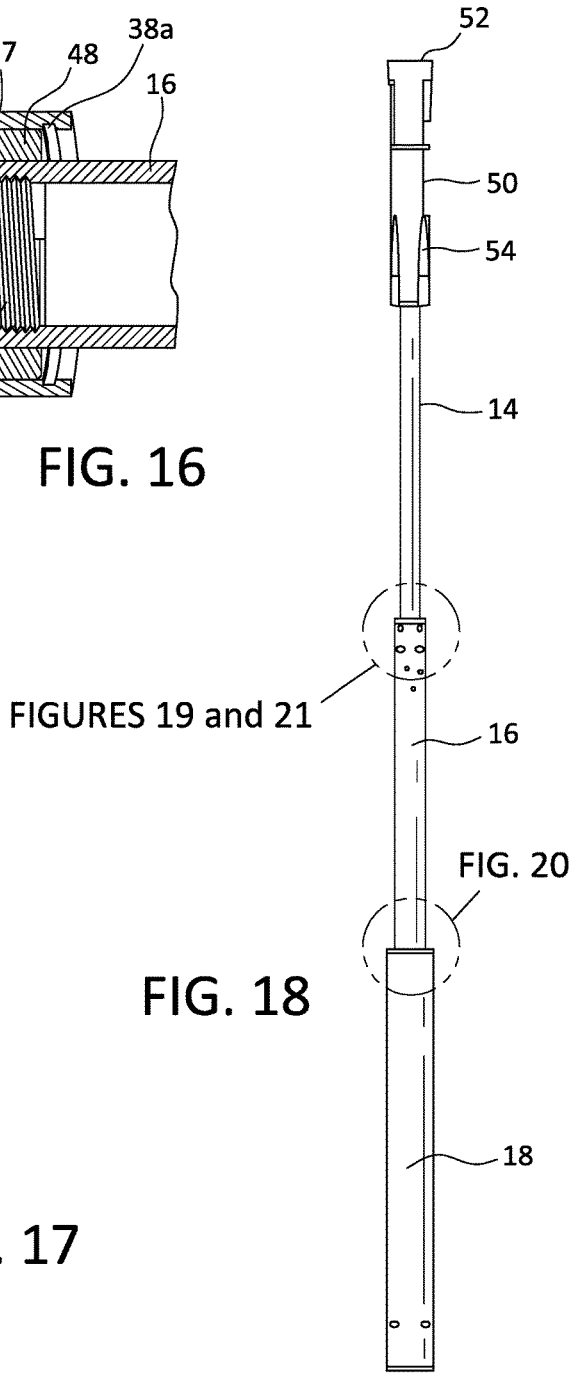
FIG. 18 is a right front perspective view of the telescoping post of the batting practice stand of FIG. 7.

As shown in FIGS. 13 and 18, the post 12' is a three-part telescoping post, with the top or distal portion 14 slidably engagable within a middle portion 16 that is in turn slidably engagable within a bottom or proximal portion 18. The telescoping slidable movement of the post 12' enables post height of this embodiment to be adjusted within a range of about 20 inches to about 32 inches. The post 12' may be constructed of metal, such as steel or galvanized steel or aluminum, or may be constructed of a composite material, such as fiberglass. The post segments 14, 16, 18 may be hollow tubes or cylinders with hollow portions. Preferably, some or all of the post 12, particularly the external surfaces of the post segments 14, 16, 18, is coated with a polymeric coating or paint.

Referring to FIG. 19, in one preferred embodiment the topmost post segment 14 is solid fiberglass. The bottom end of the topmost post segment 14 defines a threaded opening 15 configured to receive a threaded cylindrical pin or fitting 21 and to be secured by a fastener 30, such as a carriage bolt. A double gasket comprising a thimble-shaped gasket 34 with a recessed middle portion and a flanged gasket 25 to seat therein. The flanged gasket 25 may have an angled outer face. The thimble-shaped gasket 34 and flanged gasket 25 are urged against a cylindrical sleeve 23, a portion of which sleeve is engaged onto threaded cylindrical pin 21. A pin 22 is laterally inserted through the topmost post segment 14 to secure the cylindrical sleeve 23 and, optionally, the threaded cylindrical pin 21, to the topmost post segment 14. This pin 22 when inserted laterally strengthens the connection of the topmost post segment 14 to the cylindrical sleeve 23 and cylindrical pin 21 and the sliding elements of the topmost segment 14 of the telescoping post 12'. The angled outer face of the flanged gasket 25 is directed such that it is somewhat easier with less frictional engagement when the topmost post segment 14 is raised or telescoped to increase the length of the post 12', but the angled face opposes downward telescoping movement of the topmost post segment 14 into the middle post segment 16 of the post 12' with greater frictional engagement between the topmost post segment 14 and the flanged gasket 25. This combination maintains the desired height of the telescoping post, keeping sufficient frictional engagement to deter downward sliding of the telescoping post segments. The preferred angle of the angled outer face may be in the range of from about 3 degrees to about 10 degrees to the central axis of the post 12'.

Figure 21:
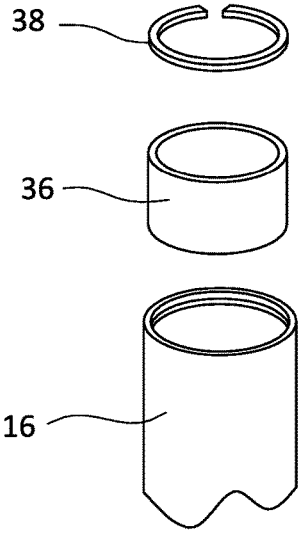
FIG. 21 is an exploded view of the lower post segment of the telescoping post of the batting practice stand if FIG. 7 at a location connecting the middle post segment to the lower post segment.

FIG. 21 shows the top portion of the middle post segment 16 of the telescoping post 12' of the preferred embodiment. The middle post segment 16 has an open end to receive a gasket 36 that is held by C-shaped retaining ring 18 seated in a groove formed inside the middle post segment, at or near the open end.

Figure 20:
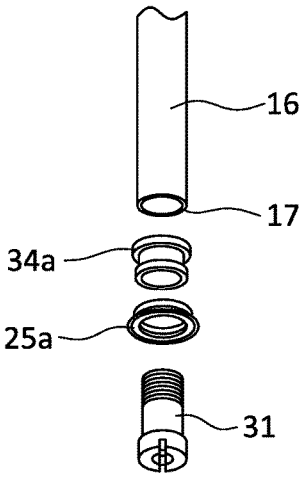
FIG. 20 is an exploded view of the middle post segment of the telescoping post of the batting practice stand at a location connecting the middle post segment to the lower post segment of the batting practice stand of FIG. 7.

FIG. 20 shows the bottom portion of the middle post segment 16 of the telescoping post 12' of the preferred embodiment. The middle post segment 16 has a hollow threaded end 17 with internal threads (not shown in FIG. 20) configured to engage with a fastener 31, such as a carriage bolt. Over the fastener 31 is threaded a double gasket comprised of a thimble-shaped gasket 34*a* with a recessed middle portion and a flanged gasket 25*a* to seat therein. The flanged gasket 25*a* may have an angled outer face. The fastener 31 secures the double gasket to the threaded end 17 of the middle post segment 16. The angled outer face of the flanged gasket 25*a* is directed such that it is somewhat easier with less frictional engagement when the middle post segment 16 is raised or telescoped to increase the length of the post 12', but the angled face opposes downward telescoping movement of the post segment 16 into the bottom segment 18 of the post 12' with greater frictional engagement between the middle post segment 16 and the flanged gasket 25*a*. This combination maintains the desired height of the telescoping post, keeping sufficient frictional engagement to deter downward sliding of the telescoping post segments. The preferred angle of the angled outer face may be in the range of from about 3 degrees to about 10 degrees to the central axis of the post 12'.

Referring to FIGS. 14 and 18, the proximal end 20 of the bottom segment 18 of the post 12' is formed as a hollow cylinder that has two L-shaped slots 26, 28 formed at opposite sides of the sidewall of proximal end 20 of the bottom segment 18 of the post 12'. (See also FIG. 5) The L-shaped slots 26, 28 have a straight that is aligned generally parallel with the central axis of the post and a straight that is generally perpendicular to the central axis of the post. A cut out 27 configured to receive the bar 64 of the base 60 is formed in each straight. A washer or stopper 40, such as a silicone washer, is placed inside the bottom segment 18 of the post 12' at or near its proximal end 20, and near or adjacent to the L-shaped slots 26, 28. Alternatively, the washer or stopper 40 may be formed as a cylinder or hollow cylinder of rubber.

The base 60 defines an opening 62 to receive the proximal end of the bottom segment 18 of the post 12'. Within the opening 62, a bar extends across 64. See FIG. 10. The two L-shaped slots 26, 28 of the bottom segment 18 of the post 12' are adapted to engage the bar 64 to secure the post 12' to the base 60. First, the proximal end 20 of the bottom segment 18 of the post 12' is inserted into the opening 62 of the base 60 so that the straights of the L-shaped slots 26, 28 that are axially aligned with the central axis of the post receive the bar 64. Then, the proximal end 20 of the bottom segment 18 of the post 12' is rotated in a first direction so that the straights of the L-shaped slots 26, 28 that are generally perpendicular to the central axis of the post 12' receive the bar 64. The washer 40 urges the bar 64 into the cut outs 27 in the straights of the L-shaped slots 26, 28 to click the post 12' into place. The post 12' may be removed from the base 60 by pushing down and rotating the proximal end 20 of the bottom segment 18 of the post 12' in the opposite direction to release the L-shaped slots 26, 28 from the bar 64 and then pulling the proximal end 20 of the bottom segment 18 of the post 12' out of the base opening 62.

The washer or stopper 40 is located at the top of the locking channel in the bottom segment 18 of the telescoping post 12' or upright. When this bottom segment 18 of the telescoping post 12' or upright is inserted into the flange bushing of the base 60 with the horizontal bar 64 in it and rotated, the washer or stopper 40, which preferably is a rubber piece, pushes down against the horizontal bar 64. When the bar 64 reaches the end of the L-shaped slots 26, 28, it is pushed down into a deeper recess 27 in the straights of the L-shaped slots and "clicks" into place.

The legs 80, 82, 84 with feet 90, 92, 94 of the embodiment shown in FIGS. 7-18 form a tripod and extend outwardly away from the base 60 to support the batting practice stand 10' in upright position. The legs 80, 82, 84 may also be retracted to a storage position when the batting practice stand 10' is not in use. Compare FIG. 7 and FIG. 12.

Figure 10:
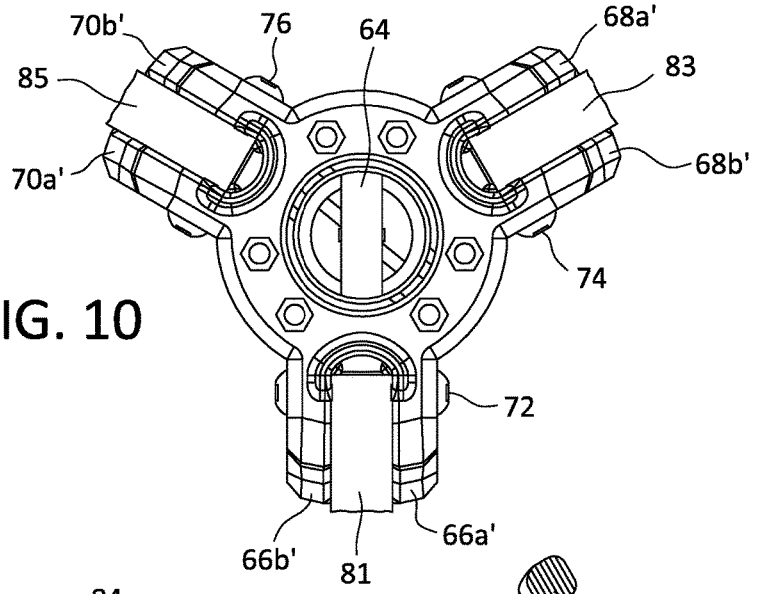
FIG. 10 is an enlarged top plan view of the base of the batting practice stand of FIG. 7.
Figure 11:
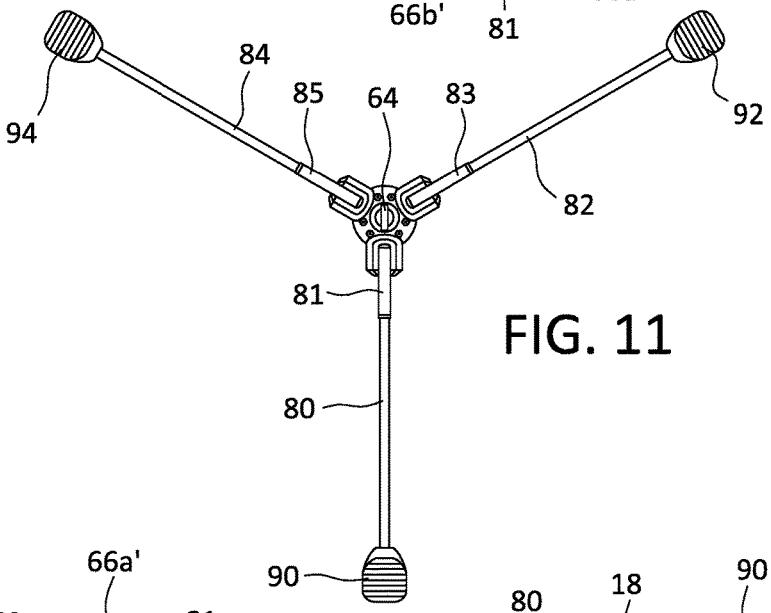
FIG. 11 is a top plan view of the base of the batting practice stand of FIG. 7 with attached support legs in extended support position.
Figure 12:
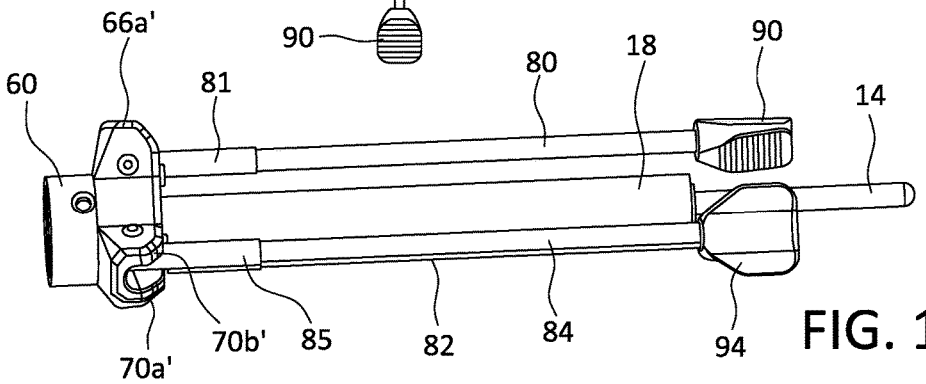
FIG. 12 is a perspective view of the batting practice stand of FIG. 7 with the support legs in retracted or storage position.

Referring now in particular detail to FIGS. 10 and 11, pairs of flanges 66*a*', 66*b*', 68*a*', 68*b*', 70*a*', 70*b*' extend outwardly from the sidewall of the base 60. Between the flanges 66*a*', 66*b*', 68*a*', 68*b*', 70*a*', 70*b*', the base 60 defines curved sockets 78', 79'. The curved sockets 78', 79' are shaped to receive curved detent buttons 100' that extend from the proximal ends of the legs 80, 82, 84. Each socket 79' receives one curved detent button 100' when the batting practice stand 10' is in the upright position with the legs 80, 82, 84 extended outwardly from the base 60 at angles to one another. Each socket 78' receives one curved detent button 100' when the batting practice stand 10' is in the storage position with the legs 80, 82, 84 positioned generally parallel to one another. A pin 72 extends across the space opening between each pair of flanges. Each pin is inserted through the sidewalls of the proximal end of a respective leg (see, e.g., FIG. 6), and through a slot 110 formed in the curved detent button of a respective leg. The curved detent button 100' is slidably movable in respect of the pin 72. A spring held within the proximal end of the leg urges the curved detent button 100 in a directly outwardly of the proximal end of the leg. The pin 72 defines the axis of rotation for the leg joined to such pin 72.

Due to the semispherical curve of the outer surface of the curved detent button 100', such button seats within a respective first socket 79' of the base 60, and is moveable in relation thereto. The spring force of the spring associated with the curved detent button 100' may be overcome to push the curved detent button 100' further into the proximal end of the leg to permit the leg to rotate from a first position supporting the batting practice stand in upright position (such as shown in FIG. 7) with the leg axes at angles to one another, to a second or storage position wherein the legs are joined to the base with their axes generally parallel to one another. In the storage position, the curved detent button 100' is seated in a respective second socket 78' of the base 60. Each curved detent button 100' remains within its respective socket 78' or 79', and its outer surface slides in contact with the socket surfaces during rotating movement of the leg from the first or upright position to the second or storage position.

The spring preferably is a conical spring or a conical coil spring.

The base, particularly the flanges, preferably is formed of metal, such as steel, galvanized steel or aluminum. The top opening of the base may be formed as a separate tubular socket that is attachable to the base. The sockets 78', 79' of the base may be separate inserts fitted into space between the flanges. The sockets may be formed of silicone or plastic.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

REFERENCE NUMERALS

10 batting practice stand
12 post
14 top post segment
15 threaded section in top post segment
16 middle post segment
17 threaded section in middle post segment
18 bottom post segment
20 open end bottom post segment
21 threaded cylindrical insert
22 retaining pin
23 sleeve
24 gasket
25, 25*a* flanged fitting
26 first L-shaped slot
27*a*/27*b* cut out in slot
28 second L-shaped slot
29 fastener
30 fastener/carriage bolt
31 fastener/carriage bolt
32 fitting in middle post section
33 washer
34, 34*a* thimble-shaped gasket
36 gasket
38, 38*a* ring seal clip
40 washer or stopper
47 threaded fitting
48 sleeve around middle post section
50 cone
52 top end opening of cone
54 gripping portions
58 bottom end cone opening
60 base
62 central opening
64 bar across central opening
66*a*/66*b* first flange
68*a*/68*b* second flange
70*a*/70*b* third flange
72 axle/pin
74 axle/pin
76 axle/pin
78 curved socket in base
79 curved socket in base
80 first leg
81 sleeve around leg
82 second leg
83 sleeve around leg
84 third leg
85 sleeve around leg
90 first foot
92 second foot
94 third foot
100 detent button
102 detent button
104 detent button
110 slot in detent button
112 spring inside leg pushing on detent button
120 baseball

I claim:

1. A batting practice stand, comprising:

a post having a proximal end and a distal end and a sidewall, said proximal end defining a first L-shaped slot through the post sidewall and defining a second L-shaped slot through the post sidewall, with the second L-shaped slot located substantially directly opposite from the first L-shaped slot;

a cone formed at or joined to the distal end of the post;

a base having a top and a side, said base defining an opening in its top adapted to receive the proximal end of the post, said base having a bar within and extending across the opening, and at least two pairs of flanges extending away from the side of said base, with a first socket defined in the base between the flanges of the first pair of flanges and with a second socket defined in the base between the second pair of flanges;

a plurality of legs extending outwardly from the base, with a first leg of the plurality of legs having a distal end and a proximal end and a first axis along its length, with a first curved detent button extending from the proximal end of the first leg, said first curved detent button fitted in the first socket, and with a second leg of the plurality of legs having a distal end and a proximal end and a second axis along its length, with a second curved detent button extending from the proximal end of the second leg, the second curved detent button fitted in the second socket, and with a third leg;

wherein the post is removably fitted to the base by seating the proximal end into the opening of the base such that the L-shaped slots engage the bar and then rotating the post, and wherein the first and second legs are rotatably moved from a storage position aligned with leg axes substantially parallel to one another to a support position with first and second leg axes at angles to one another by slidably rotating the first curved detent button within the first socket and slidably rotating the second curved detent button within the second socket.

2. The batting practice stand of claim 1, further comprising a first spring within the first leg that urges the first curved detent button in a direction outwardly of the first leg, and a second spring within the second leg that urges the second curved detent button in a direction outwardly of the second leg.

3. The batting practice stand of claim 1, wherein a first pin extends through the first pair of flanges of the base, and wherein the first curved detent button further defines an elongated slot that receives the first pin so that the first curved detent button is slidably movable against said first pin.

4. The batting practice stand of claim 3, wherein a second pin extends through the second pair of the flanges of the base, and wherein the second curved detent button further defines an elongated slot that receives the second pin, so that the second curved detent button is slidably movable against said second pin.

5. The batting practice stand of claim 3, wherein the proximal end of the first leg has a sidewall that defines an inner cavity into which the first curved detest button is slidably received, and at least a portion of the first pin extends through the sidewall and into the inner cavity of the first leg.

6. The batting practice stand of claim 4, wherein the proximal end of the second leg has a sidewall that defines an inner cavity into which the second curved detent button is slidably received, and at least a portion of the second pin extends through the sidewall and into the inner cavity of the second leg.

7. The batting practice stand of claim 1, wherein the first socket defines an opening facing a first direction and the second socket defines an opening facing a second direction, and the first direction is at an angle to the second direction.

8. The batting practice stand of claim 1, further comprising a compressible washer or stopper installed inside the proximal end of the post.

9. The batting practice stand of claim 1, further comprising a first spring within the first leg that urges the first curved detent button in a directly outwardly of the first leg, and a second spring within the second leg that urges the second curved detent button in a direction outwardly of the second leg;

further comprising a first pin extending through the first pair of flanges of the base, wherein the first curved detent button further defines an elongated slot that receives the first pin so that the first curved detent button is slidably movable against said first pin, wherein the proximal end of the first leg has a sidewall that defines an inner volume into which the first curved detent button is slidably received, and at least a portion of the first pin extends through the sidewall and into the inner cavity of the first leg, with the first pin defining an axis of rotation for the first leg; and further comprising a second pin extending through the second pair of the flanges of the base, wherein the second curved detent button further defines an elongated slot that receives the second pin, so that the second curved detent button is slidably movable against said second pin, wherein the proximal end of the second leg has a sidewall that defines an inner volume into which the second curved detent button is slidably received, and at least a portion of the second pin extends through the sidewall and into the inner cavity of the second leg, with the second pin defining an axis of rotation for the second leg.

10. The batting practice stand of claim 1, wherein a polymer or rubber foot is molded onto or joined to the first leg, and a second polymer or rubber foot is molded onto or joined to the second leg.

11. The batting practice stand of claim 1, wherein the first curved detent button is semispherical, and the second curved detent button is semispherical.

12. The batting practice stand of claim 2, wherein the first spring and the second spring are selected from the group consisting of coil springs and conical coil springs.

13. The batting practice stand of claim 1, wherein the cone comprises a flexible rolled rubber or polymer.

14. The batting practice stand of claim 1, wherein the cone has an outer surface into which one or more gripping recesses is formed.

15. The batting practice stand of claim 1, wherein the post has two or more telescoping sections or segments slidably moved in relation to one another to adjust the height of the post.

16. The batting practice stand of claim 15, wherein a topmost of the two or more telescoping segments is a solid material with a threaded female part inserted into its proximal end configured to receive a gasket mounting.

17. The batting practice stand of claim 16, further comprising a retaining pin inserted laterally through the topmost of the two or more telescoping segments and through a fastener securing a gasket to the topmost of the two or more telescoping segments.

18. The batting practice stand of claim 16, wherein the gasket comprises a first gasket with a recessed portion around its center and a second gasket with an angled outer face seated in the recessed portion of the first gasket.

19. The batting practice stand of claim 18, wherein the angled outer face is directed at an angle from about 3 degrees to about 10 degrees from a central axis of the post.

20. A batting practice stand, comprising:

a post having a proximal end and a distal end and a sidewall, said proximal end defining a first L-shaped slot through the post sidewall and defining a second L-shaped slot through the post sidewall, with the second L-shaped slot located substantially directly opposite from the first L-shaped slot;

a cone formed at or joined to the distal end of the post;

a base having a top and a side, said base defining an opening in its top adapted to receive the proximal end of the post, said base having a bar within and extending across the opening, and at least three pairs of flanges extending away from the side of said base, with a first socket defined in the base between the flanges of the first pair of flanges, and with a second socket defined in the base between the second pair of flanges, and with a third socket defined in the base between the third pair of flanges;

a plurality of legs extending outwardly from the base, with a first leg of the plurality of legs, having a distal end and a proximal end and a first axis along its length, with a first curved detent button extending from the proximal end of the first leg, said first curved detent button fitted in the first socket, with a second leg of the plurality of legs having a distal end and a proximal end and a second axis along its length, with a second curved detent button extending from the proximal end of the second leg, the second curved detent button fitted in the second socket, and with a third leg of the plurality of legs having a distal end and a proximal end and a third axis along its length, with a third curved detent button extending from the proximal end of the third leg, the third curved detent button fitted in the third socket;

wherein the post is removably fitted to the base by seating the proximal end into the opening of the base such that the L-shaped slots engage the bar and then rotating the post, and wherein the first, second and third legs are rotatably moved from a storage position aligned with leg axes substantially parallel to one another to a support position with the first and second leg axes at angles to one another, and with the third and second leg axes at angles to one another, by slidably rotating the first curved detent button within the first socket and slidably rotating the second curved detent button within the second socket.

* * * * *